US012222103B2

(12) United States Patent
Rogemond

(10) Patent No.: US 12,222,103 B2
(45) Date of Patent: Feb. 11, 2025

(54) MODULAR BURNER AND FURNACE INCLUDING THIS BURNER

(71) Applicant: ERATEC, Vaulx-Milieu (FR)

(72) Inventor: Eric Rogemond, Satolas-et-Bonce (FR)

(73) Assignee: ERATEC, Vaulx-Milieu (FR)

( * ) Notice: Subject to any disclaimer, the term of this patent is extended or adjusted under 35 U.S.C. 154(b) by 511 days.

(21) Appl. No.: 17/573,223

(22) Filed: Jan. 11, 2022

(65) Prior Publication Data

US 2022/0186925 A1 Jun. 16, 2022

Related U.S. Application Data

(63) Continuation of application No. PCT/FR2020/051250, filed on Jul. 10, 2020.

(30) Foreign Application Priority Data

Jul. 11, 2019 (FR) ..... 1907813

(51) Int. Cl.
*F23D 14/10* (2006.01)

(52) U.S. Cl.
CPC .... *F23D 14/10* (2013.01); *F23D 2900/14041* (2013.01)

(58) Field of Classification Search
CPC .. F23D 14/10; F23D 2900/14041; F23C 6/04; F23C 2201/20; F23C 2201/30
USPC ..... 431/328
See application file for complete search history.

(56) References Cited

U.S. PATENT DOCUMENTS 4,543,940 A * 10/1985 Krill ..... F23D 14/16 126/92 C
5,707,226 A * 1/1998 Bogtstra ..... F23D 14/125 431/328
6,354,831 B1 * 3/2002 Wilk, Jr. ..... F23D 14/16 431/328

FOREIGN PATENT DOCUMENTS

| | | |
|---|---|---|
| CN | 204213927 | 3/2015 |
| EP | 2914903 | 9/2015 |
| WO | 2008003869 | 1/2008 |

OTHER PUBLICATIONS

International Search Report for International Application PCT/FR2020/051250, mailed Sep. 30, 2020.
Office Action issued in corresponding EP Application 20 750 708.8, issued May 13, 2024, 5 pages.

* cited by examiner

*Primary Examiner* — Ko-Wei Lin
(74) *Attorney, Agent, or Firm* — Burris Law, PLLC

(57) ABSTRACT

A burner includes a porous support and a combustion tube along which is mounted the porous support. The combustion tube has one or more openings configured to pass fuel to the porous support. The combustion tube is formed by a plurality of tubular modules assembled together. The burner includes at least one distribution tube extending inside the combustion tube and configured to distribute fuel in a predetermined manner in the combustion tube.

14 Claims, 9 Drawing Sheets

MODULAR BURNER AND FURNACE INCLUDING THIS BURNER

CROSS-REFERENCE TO RELATED APPLICATIONS

Figure 1:
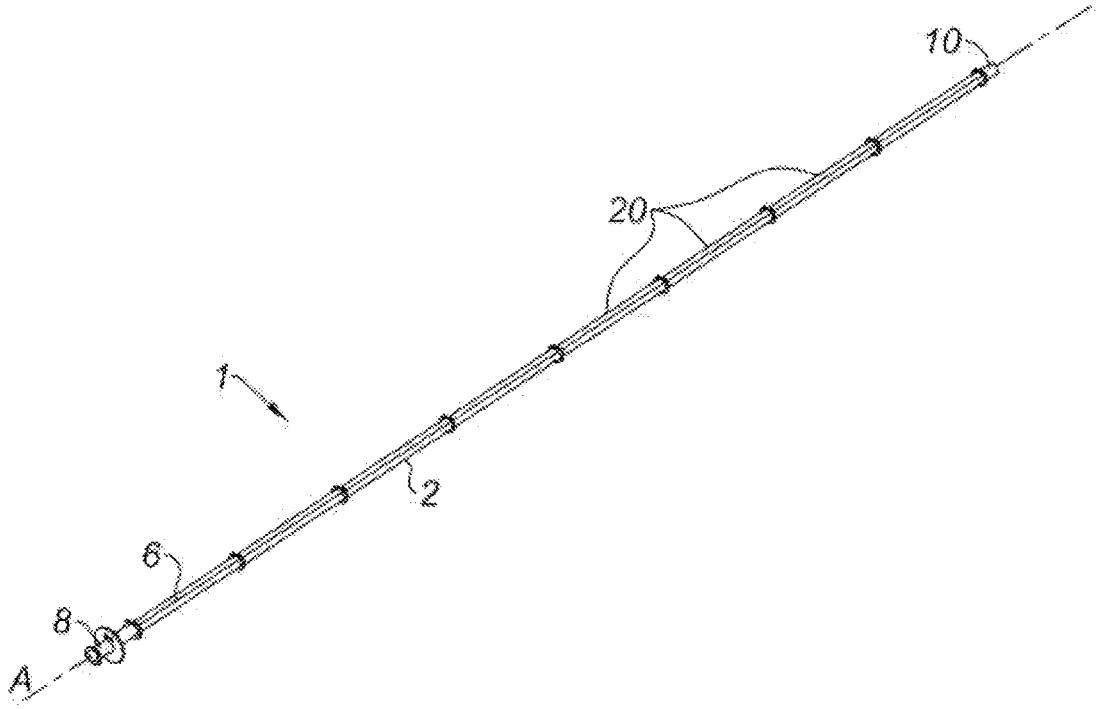

This application is a continuation of International Application No. PCT/FR2020/051250, filed on Jul. 10, 2020, which claims priority to and the benefit of FR 19/07813 filed on Jul. 11, 2019. The disclosures of the above applications are incorporated herein by reference.

FIELD

The present disclosure relates to a burner and a furnace including this burner.

BACKGROUND

The statements in this section merely provide background information related to the present disclosure and may not constitute prior art.

Burners are combustion devices intended to produce heat by combustion of a mixture of fuel (usually a gas) and an oxidizer (generally air).

There are different types of burners, such as atmospheric burners, forced air burners or premix burners.

Premix burners are burners where air is mixed with gas in a premix chamber, with or without the aid of a fan, before distribution on the surface of a porous support where the flame is developed.

It is known to produce this porous support by an assembly of metal fibers. The fibers are conventionally made from a fire-resistant alloy, for example Fecralloy®, configured to resist corrosion at temperatures above 1000° C.

These metallic fibers can be woven to obtain a flexible fabric capable of offering a wide variety of shapes. The metallic textile is traditionally mounted on a steel casing which contains distribution plates intended to ensure the homogeneity of the combustion.

Burners with porous support have many advantages relative to other burners, such as for example homogeneous combustion with a wide modulation range. These burners in fact allow thermal transfer, either by radiation (infrared) or by convection (blue flame), as well as an easy transition between these two thermal transfer modes. The burners with porous support also offer high thermal efficiency with low emission rates (CO, NOx), low pressure drop, low thermal inertia, safety against backfire, as well as resistance to mechanical or thermal shocks.

It is thus known to use burners with a porous support in various fields such as the drying or the surface treatment of paints or coatings, the heat treatment of technical textiles, or for the cooking of foods such as cookies, pancakes, breads, brioches, etc., in food furnaces.

Generally, burners with a porous support can extend up to a length in the range of 2 to 3 meters. However, in the case of food furnaces, where the burners are arranged perpendicular to a conveyor belt displacing the food to be cooked, the width of this conveyor belt can exceed 4 to 8 meters. There is therefore a need for large burners.

A drawback of large burners is their deformation under the effect of expansion. This deformation generates a pronounced deflection, also called the banana effect, which can alter the homogeneity of the cooking and the lifetime of the burner (e.g., tearing of the metal fabric).

Another drawback of large burners is their size and their mass. This increases transport costs and can complicate their installation inside baking furnaces.

Another drawback is the edge effect that can occur on the sides of the furnace. It is necessary to provide the same amount of energy over the entire width of the conveyor belt to cook food evenly. As the heat is lower on the sides of the furnace, taking into account the energy absorption by its side walls, there is a need for a large burner capable of overcome these edge effects.

The teachings of the present disclosure overcome all or part of these drawbacks by providing a burner allowing a reduction in the deflection, a reduction in the size to reduce transport costs and facilitate assembly, and a homogeneous heat transfer over its entire length.

SUMMARY

This section provides a general summary of the disclosure and is not a comprehensive disclosure of its full scope or all of its features.

The present disclosure relates to a burner including a porous support and a combustion tube along which is mounted the porous support, the combustion tube having one or more openings for allowing fuel to pass to the porous support, wherein the combustion tube is formed of a plurality of tubular modules assembled together and in that the burner further includes at least one distribution tube extending inside the combustion tube to distribute the fuel in a predetermined manner in the combustion tube.

Thus, the burner according to the disclosure, via its combustion tube formed by an assembly of modular sections, makes it possible to have a large burner while limiting the deflection and reducing the size and transport costs. The distribution tube allows a homogeneous distribution of the fuel within the combustion tube.

According to one form, the opening(s) of the combustion tube are slots orthogonal to a longitudinal axis of the burner.

This allows the fuel to pass more easily to the porous support.

Advantageously, the burner has a supply module including sparking means and one or more sparking orifices arranged under the sparking means and configured to allow more fuel to pass than a section of the same length of the combustion tube.

This makes it possible to send a surplus of fuel to the level of the sparking means in order to facilitate the sparking.

According to one form, the burner includes fixing means configured to fix in a sealed manner adjacent tubular modules.

According to one form, the fixing means include fixing flanges bearing against one another.

This bearing-plane contact, flange against flange, ensures an effective sealing between two modules. This also makes it possible to decrease the deflection.

According to one form, the fixing flanges support the at least one distribution tube inside the combustion tube.

According to one form, the fixing means include calibrated leakage means allowing fuel to pass to the porous support at the junction of the adjacent tubular modules.

This ensures the continuity of the flame at the junction of two modules. These calibrated leakage means can be formed by a notched portion of the fixing flanges.

According to one form, the burner includes a single distribution tube.

According to one form, the distribution tube includes one or more distribution orifices arranged opposite the porous support.

This feature makes it possible to create a pressure drop aimed at better distributing the fuel within the combustion tube.

According to one form, the burner includes several distribution tubes, of which primary distribution tube intended to distribute the fuel in a first combustion zone formed by one or more tubular modules of the combustion tube, and at least one secondary distribution tube configured to distribute the fuel in a predetermined manner in a downstream combustion zone with respect to the first combustion zone and formed by one or more other tubular modules of the combustion tube.

This allows the independent management of several combustion zones.

Advantageously, the at least one secondary distribution tube includes a blind part extending at least through the first combustion zone.

According to one form, the primary distribution tube and the at least one secondary distribution tube have a distribution portion having an upstream portion having a larger perforation zone than a downstream portion.

This feature makes it possible to ensure the continuity of the flame. It prevents a dark zone from appearing at the start of the distribution portion due to the fuel propagation speed.

By larger perforation zone on an upstream portion compared to a downstream portion of the distribution portion of the distribution tube, it is meant that the total distribution zone is greater than that of a portion of the same length located downstream with respect to this one. Thus, more fuel escapes through this upstream portion than through a downstream portion of the same length.

It will be noted that upstream and downstream are here defined with respect to the overall direction of circulation of the fuel inside the burner.

According to one form, the primary distribution tube and the at least one secondary distribution tube have a distribution portion including distribution orifices arranged facing the porous support.

This feature allows better fuel distribution. The flow of fuel is not hampered by the presence of the other distribution tube(s).

According to one form, the primary distribution tube and the at least one secondary distribution tube have an end portion including an axial plug and a radial outlet opening.

This allows slowing down the arrival of fuel at the end of the combustion tube zone and creates a pressure drop aiming at better distributing the fuel within the combustion tube.

Advantageously, the radial outlet is arranged opposite the porous support.

According to one form, the terminal portion is arranged at a distance from a downstream end of the corresponding combustion zone, and in one optional form is at an upstream end of the last of the tubular modules forming the corresponding combustion zone.

This feature allows a homogeneous distribution of the fuel in the corresponding zone of the combustion tube while avoiding a surplus of fuel in the last tubular module of this zone.

Advantageously, the distribution portion of each distribution tube extends along only part of the corresponding zone of the combustion tube. In particular, each zone of the combustion tube is formed of several consecutive tubular modules, and the end portion extends into the last tubular module of the corresponding zone, near the upstream end of this tubular module, the end portion being, in one optional form, closer to the upstream end than to the downstream end of the last tubular module of the corresponding zone.

According to one form, the burner includes adjustment means configured to independently adjust the flow rate of fuel entering each distribution tube.

According to another form, the teachings of the present disclosure provide for a furnace including a burner having one or more of the aforementioned features.

Further areas of applicability will become apparent from the description provided herein. It should be understood that the description and specific examples are intended for purposes of illustration only and are not intended to limit the scope of the present disclosure.

DRAWINGS

Figure 2:
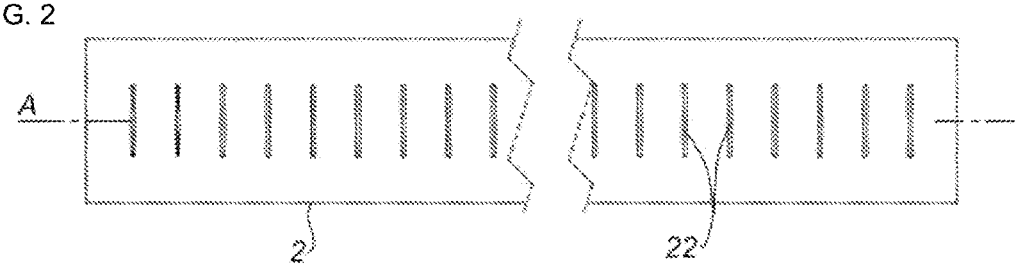
Figure 3:
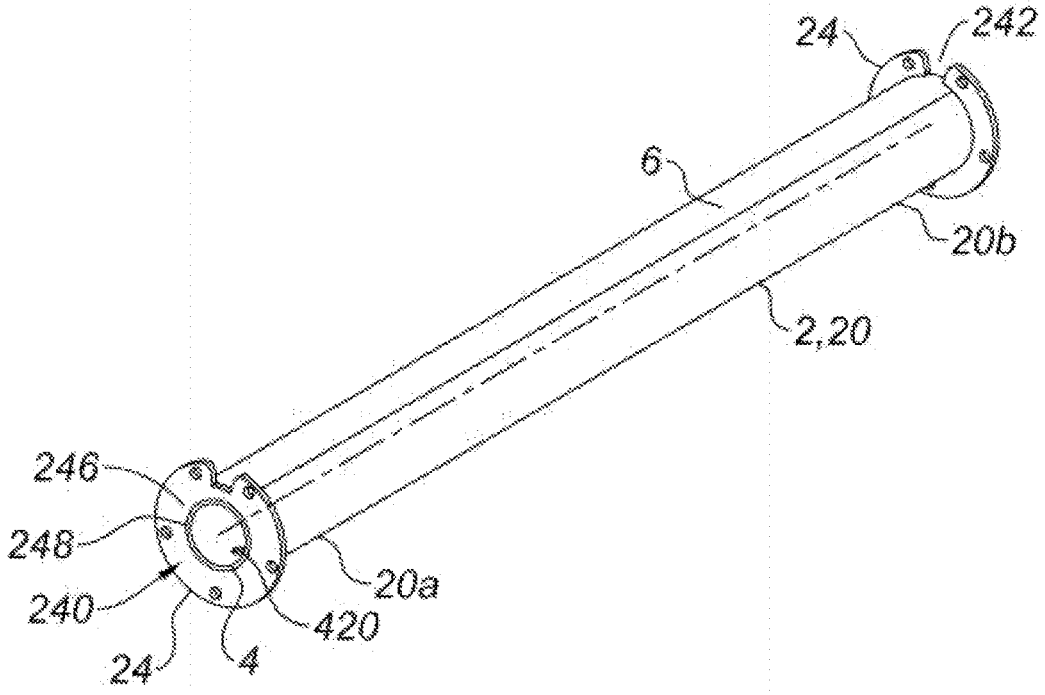
Figure 4:
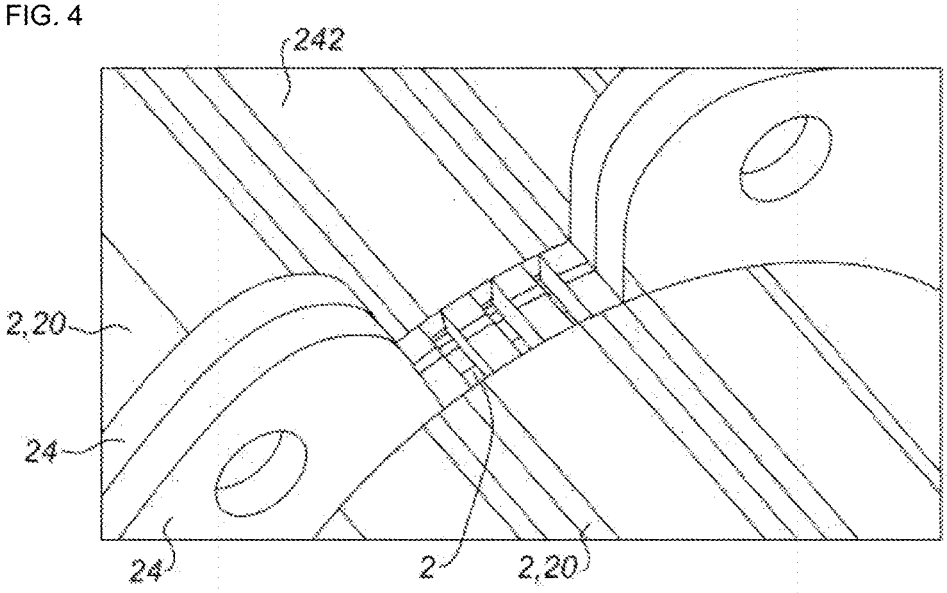
Figure 5:
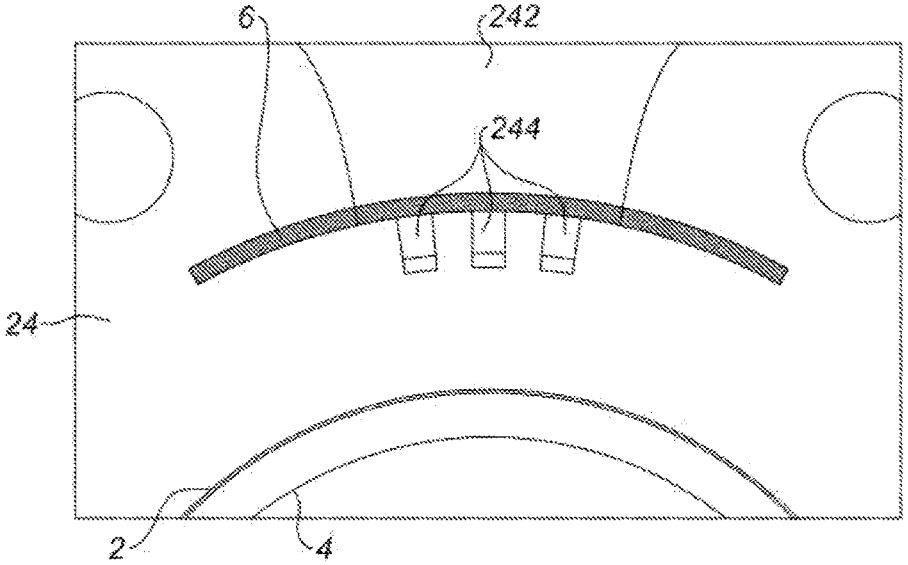
Figure 6:
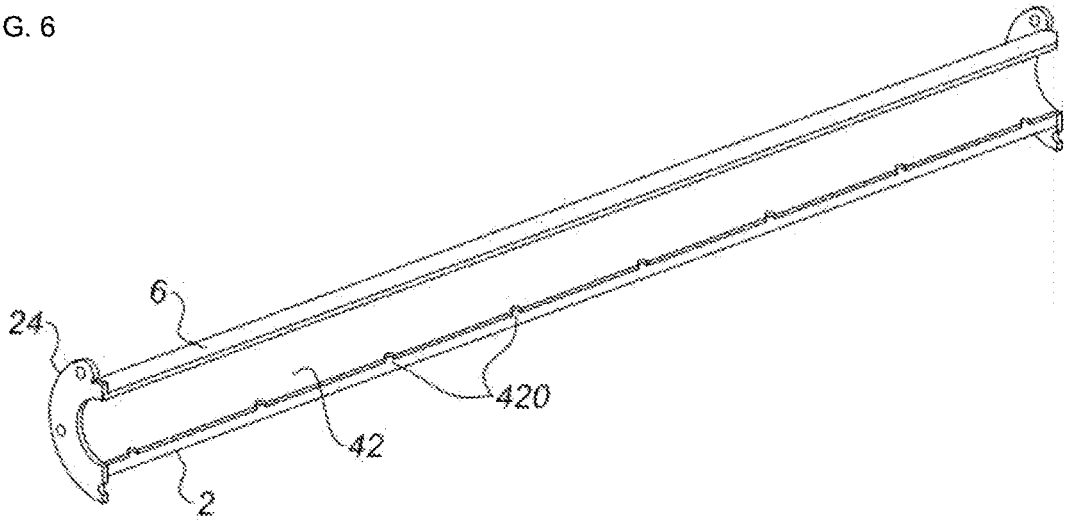
Figure 7:
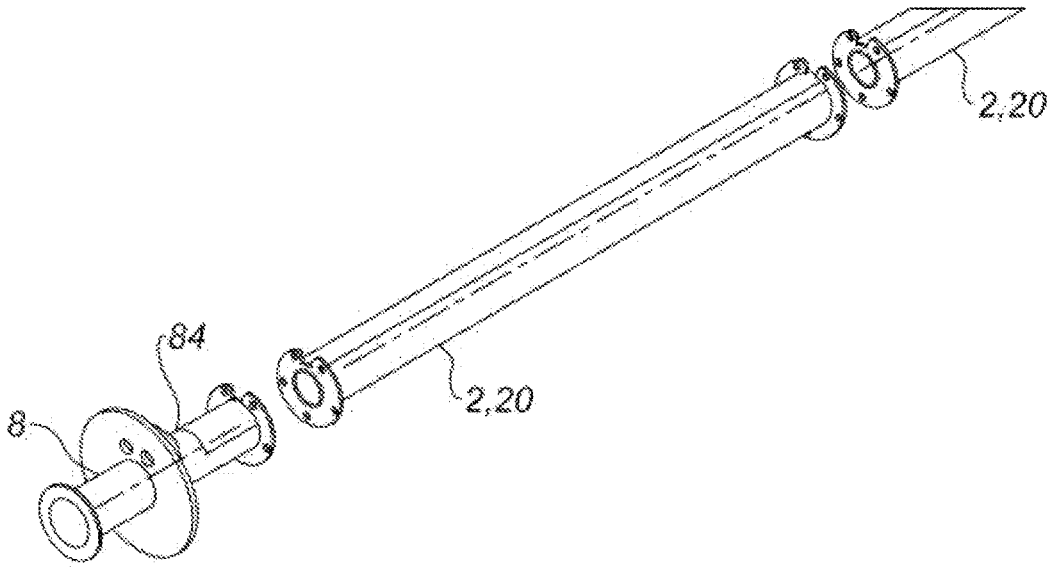
Figure 8:
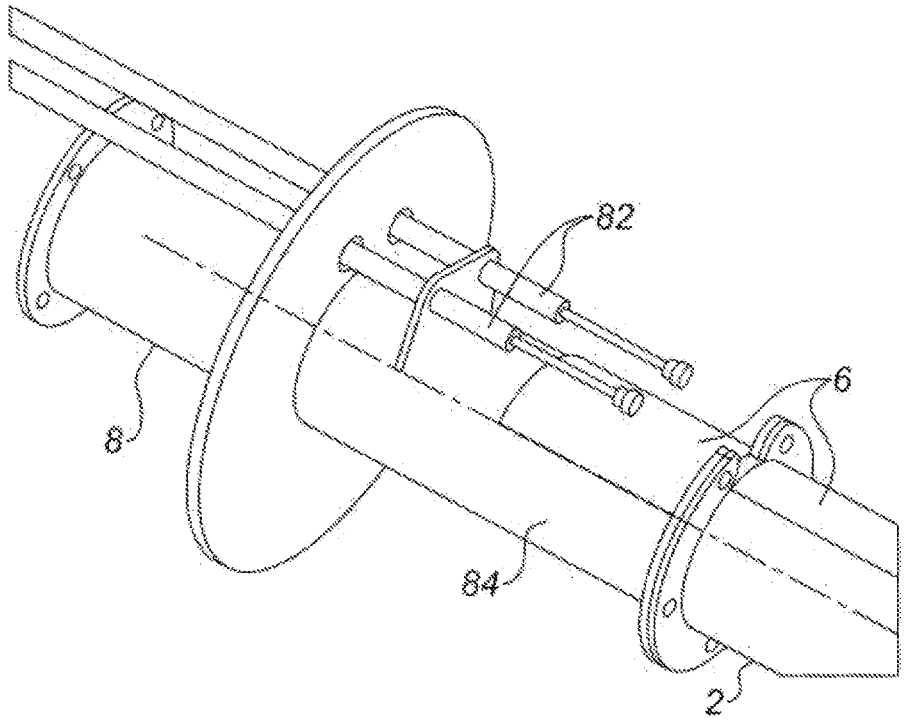
Figure 9:
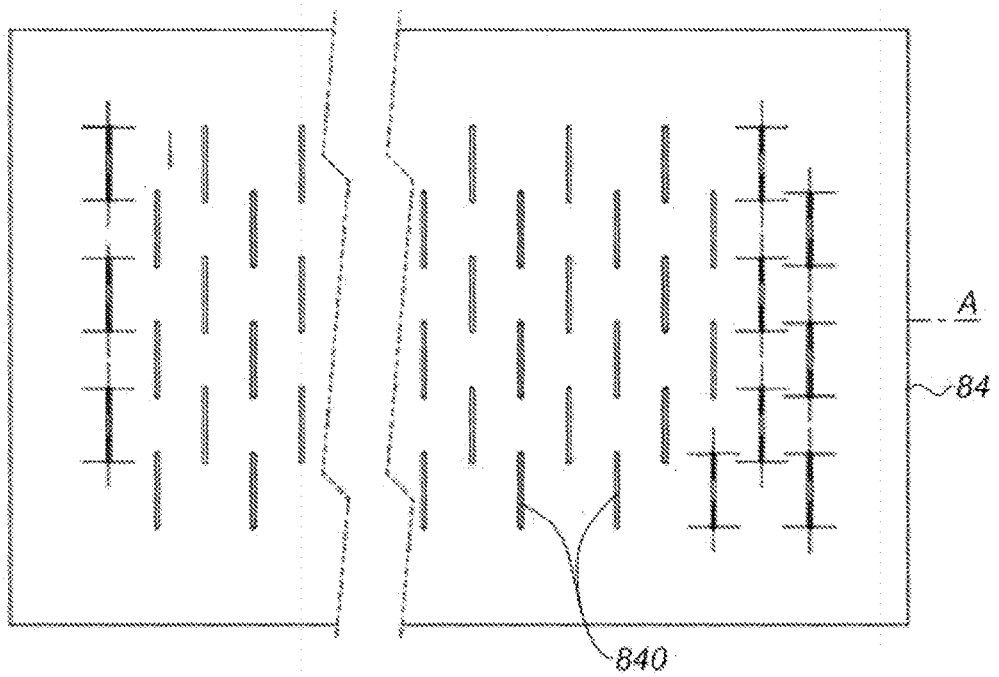
Figure 10:
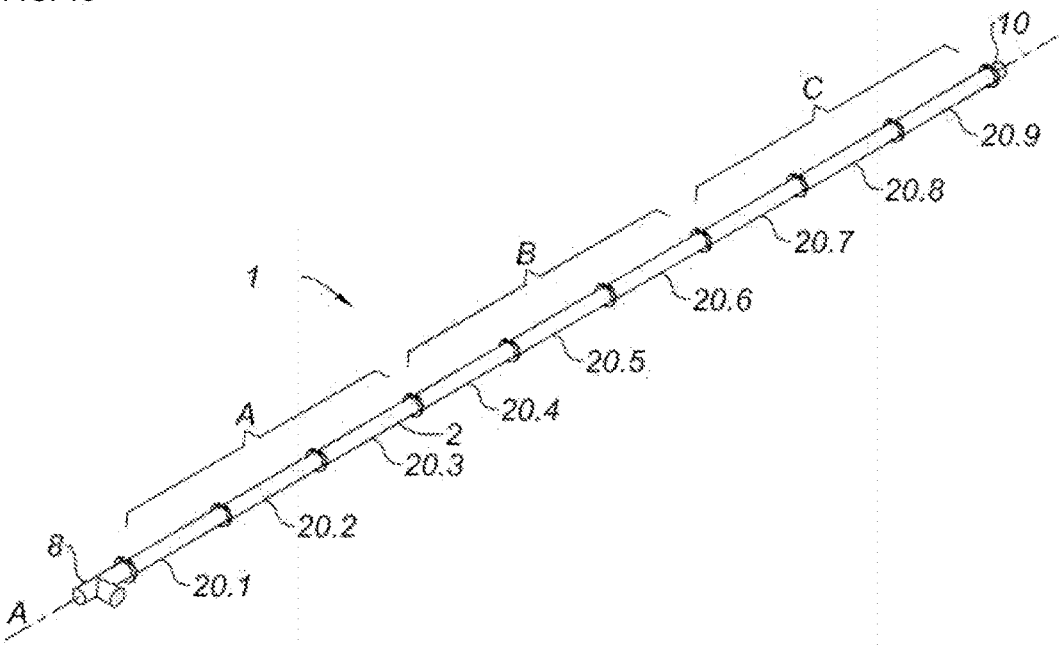
Figure 11:
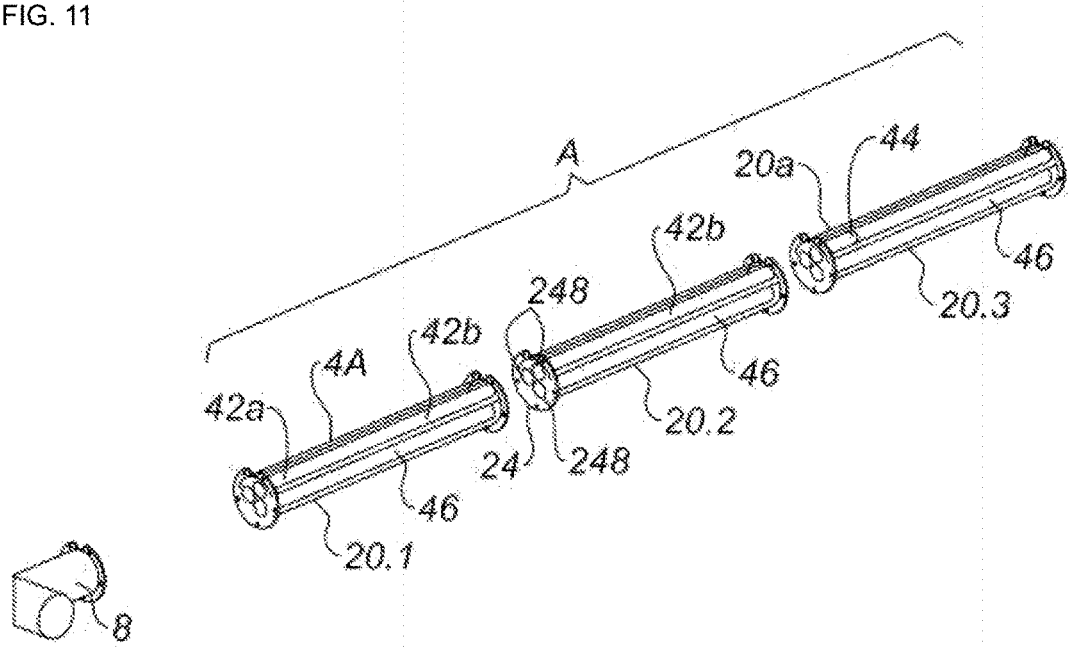
Figure 12:
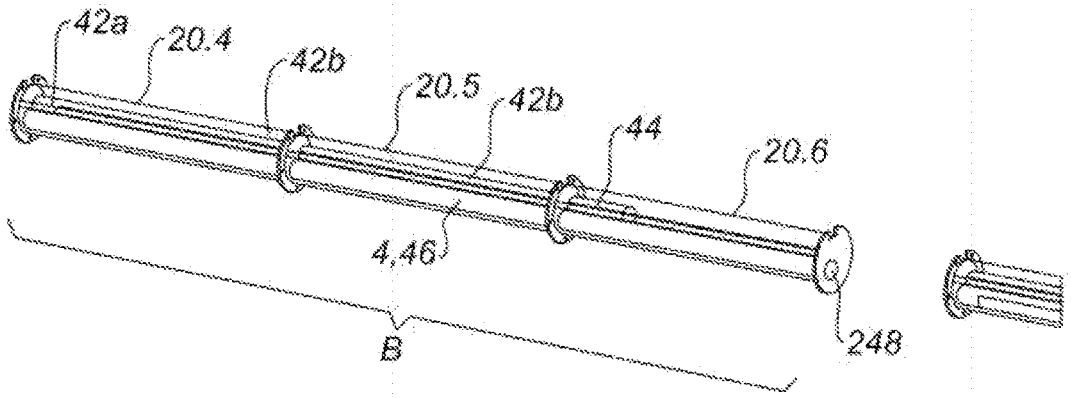
Figure 13:
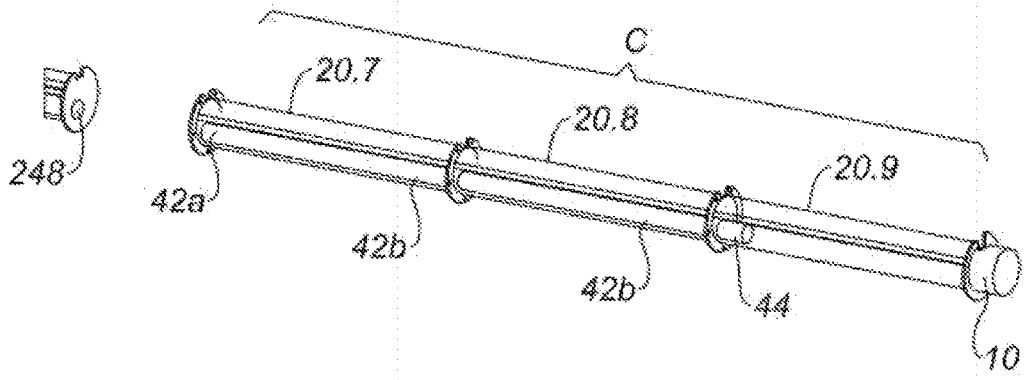
Figure 14:
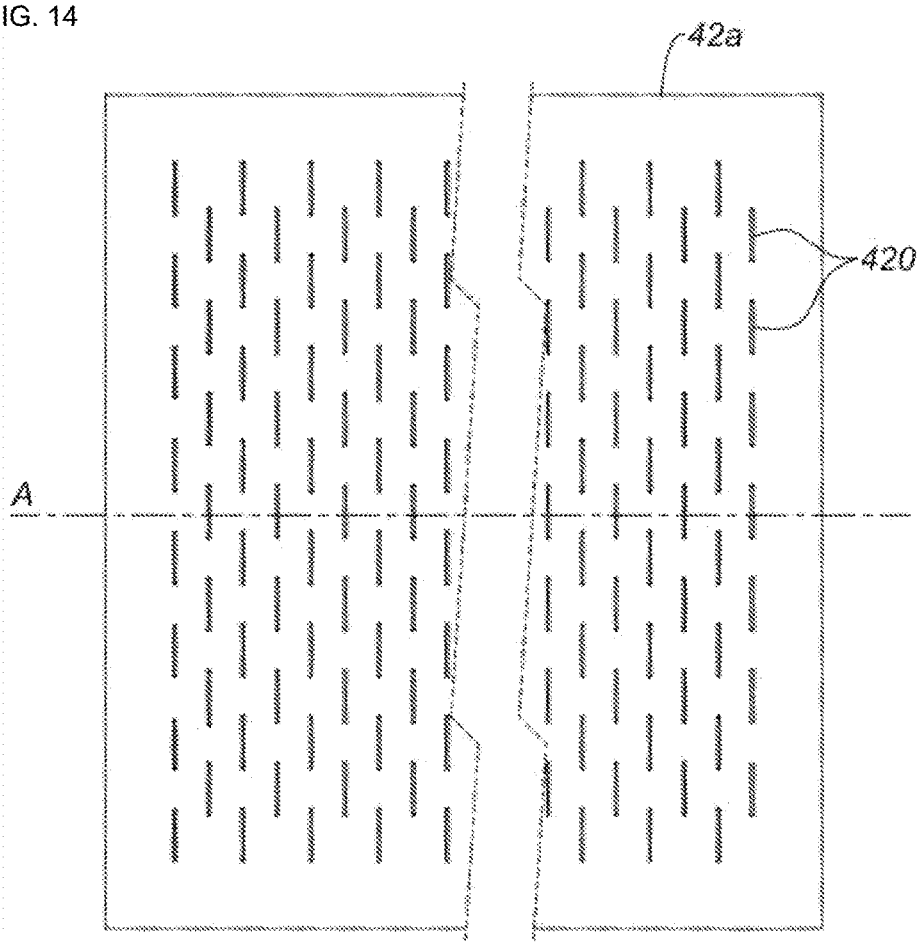
Figure 15:
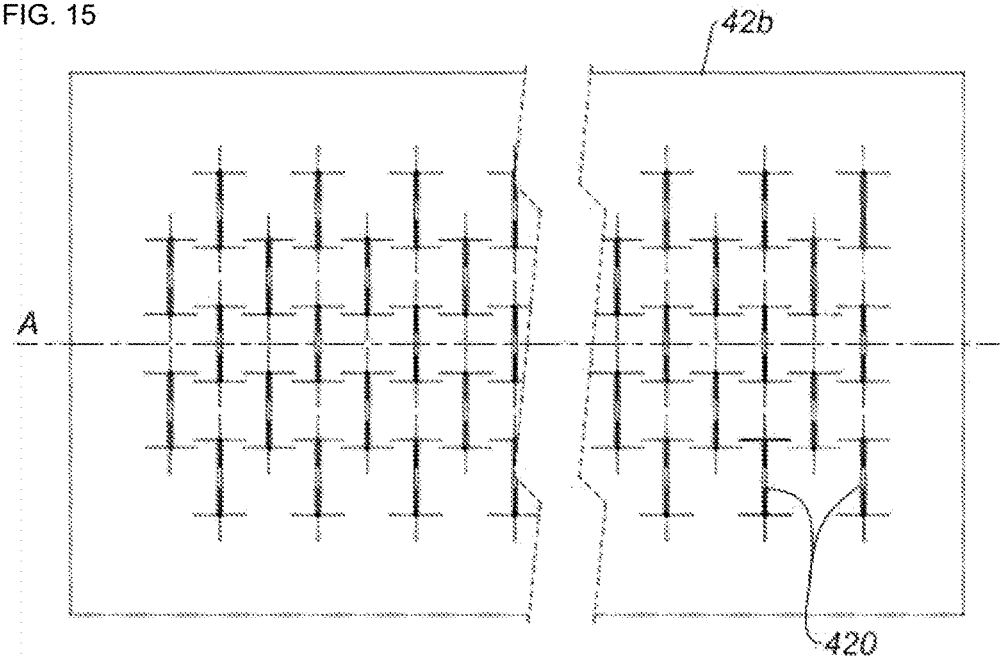
Figure 16:
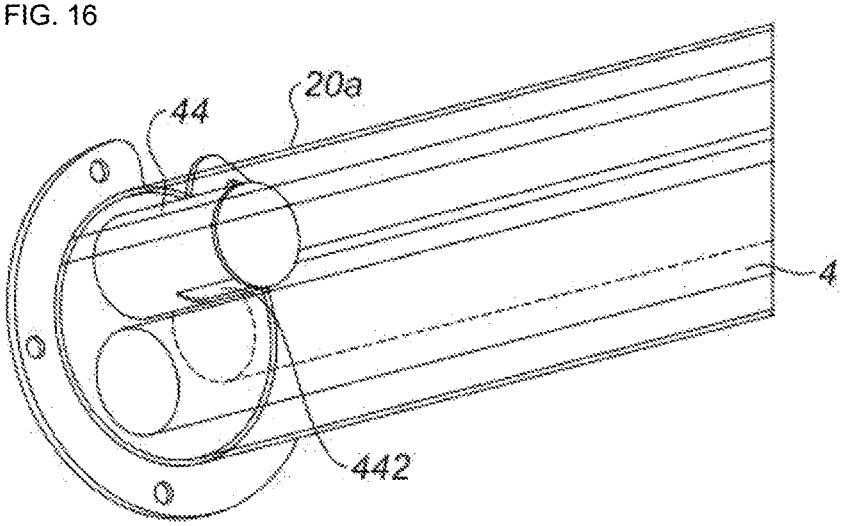
Figure 17:
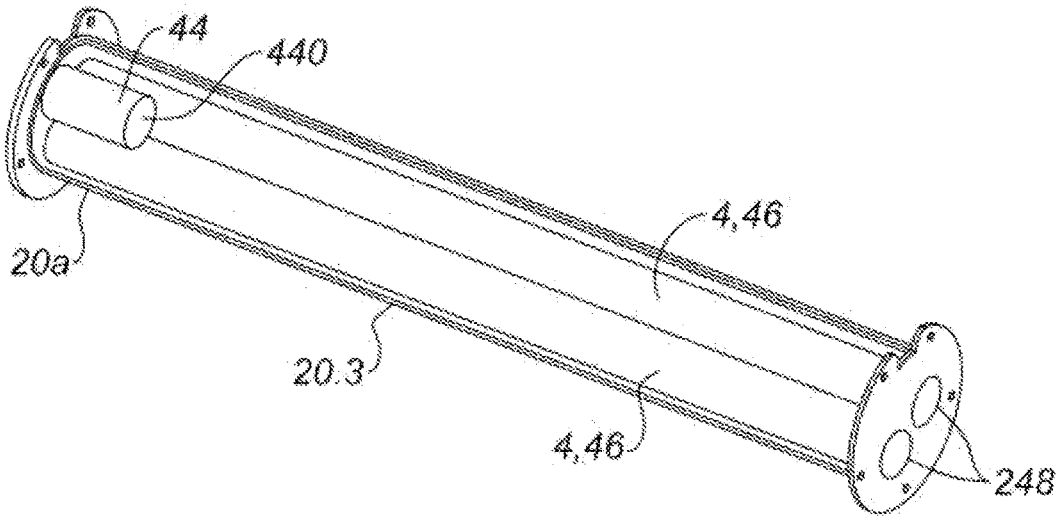
Figure 18:
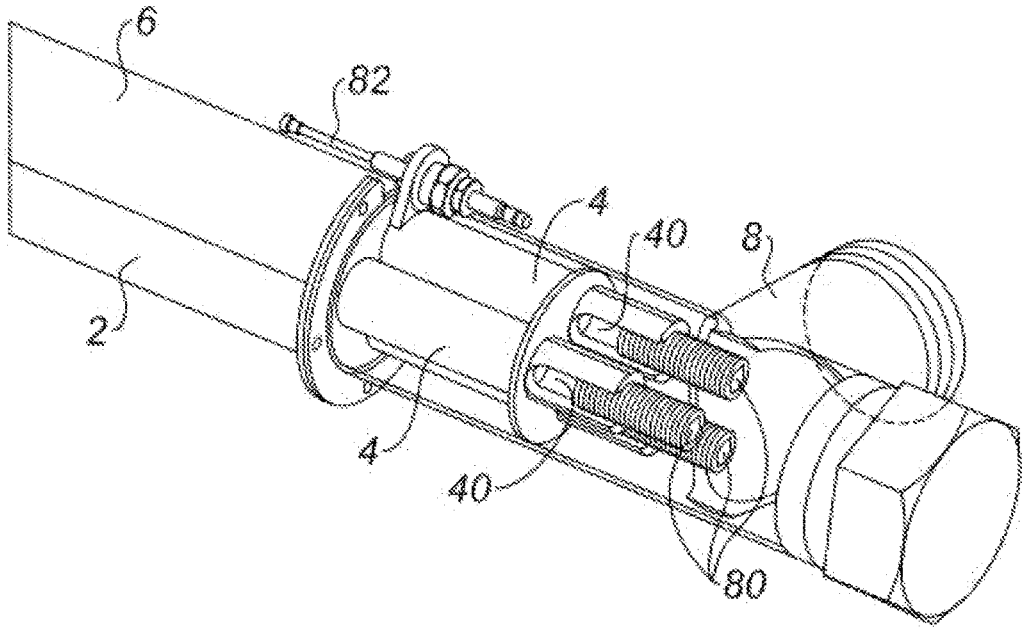

In order that the disclosure may be well understood, there will now be described various forms thereof, given by way of example, reference being made to the accompanying drawings, in which:

FIG. 1 is a perspective view of a burner according to one form of the present disclosure, FIG. 2 is a top view of part of the combustion tube of a burner according to one form of the present disclosure, FIG. 3 is a perspective view of a tubular module of the combustion tube of a burner according to one form of the present disclosure, FIG. 4 is a perspective view of a junction between two consecutive tubular modules of a burner according to one form of the present disclosure, FIG. 5 is a sectional view of a burner according to one form of the present disclosure, illustrating the junction between two consecutive tubular modules of this burner, FIG. 6 is a sectional view along a longitudinal median axis of the tubular module of FIG. 3, FIG. 7 is an exploded perspective view of a burner according to one form of the present disclosure, showing the burner supply module, FIG. 8 is a perspective view of a burner supply module according to one form of the present disclosure, FIG. 9 is a top view of a portion of a burner supply module according to one form of the present disclosure, FIG. 10 is a perspective view of a burner according to one form of the present disclosure, FIG. 11 is a perspective and transparency view of a first combustion zone of the burner of FIG. 10, FIG. 12 is an exploded perspective and transparency view of a second combustion zone of the burner in FIG. 10, FIG. 13 is an exploded perspective and transparency view of a third combustion zone of the burner of FIG. 10, FIG. 14 is a top view of an upstream portion of the distribution portion of a distribution tube of a burner according to one form of the present disclosure, FIG. 15 is a top view of a portion of the distribution portion of a distribution tube of a burner according to one form of the present disclosure, downstream of the portion of FIG. 14, FIG. 16 is a perspective transparency view of the last module of the first combustion zone of the burner of FIG. 10, FIG. 17 is a perspective transparency view of the last module of the first combustion zone of the burner of FIG. 10, FIG. 18 is a perspective transparency view of a burner supply module according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a burner 1 according to one form of the present disclosure. The burner 1 is intended to equip a furnace, in particular a food furnace. The burner 1 longitudinally extends along an axis A, in one optional form extends over a length of at least 4 meters, and may be for example between 4 and 8 meters. The burner 1 is therefore a large burner 1.

The burner 1 includes a combustion tube 2 formed of several tubular modules 20, a distribution tube 4 arranged inside the combustion tube 2, and a porous support 6 supported by the combustion tube 2 and on the surface of which is intended to burn a pre-mixture of air and gas. The burner 1 is advantageously a burner 1 with premixing and surface combustion.

The porous support 6 is a fuel permeable support, for example a premix of gas and air. The porous support 6 advantageously includes metallic fibers, which can be woven so that the porous support 6 forms a flexible metallic fabric. These metal fibers are made of a fire-resistant alloy configured to resist corrosion at temperatures above 1000° C., such as, for example, Fecralloy®.

The porous support 6 selectively allows using a heat transfer mode by radiation (infrared) or by convection (blue flame), and offers an easy transition between these two modes. By radiation heat transfer mode (infrared) is meant a thermal transfer with a power density in the range of 100 to 500 $kW \cdot m^{-2}$. By a thermal transfer mode by convection (blue flame) is meant a thermal transfer with a power density in the range of 500 to 10,000 $kW \cdot m^{-2}$.

The combustion tube 2 extends longitudinally along the axis A and supports the porous support 6. The porous support 6 can be fixed on the combustion tube 2 by spot welding (fusion of the fabric forming the porous support 6 with the combustion tube 2). The porous support 6 therefore also extends longitudinally along the axis A, in particular, over the entire length of the combustion tube 2.

The combustion tube 2 is hollow, advantageously cylindrical. The combustion tube 2 has an upstream end, connected and closed by a supply module 8, and a downstream end, connected and closed by a closure module 10.

The combustion tube 2 is perforated. As represented in FIG. 2, the combustion tube 2 has, along its lateral wall, a plurality of combustion openings 22, passing through and arranged under the porous support 6 to allow fuel to flow from the inside of the combustion tube 2 to the porous support 6 where combustion takes place. These openings 22 can be arranged longitudinally at regular intervals from one another. They may have the form of slots, in particular slots orthogonal to the longitudinal axis A. They are for example aligned along the axis A, as illustrated in FIG. 2.

The combustion tube 2 includes a plurality of tubular modules 20 aligned and connected one after the other so as to form the combustion tube 2. Each tubular module 20 therefore constitutes a section of the combustion tube. Thus, as visible in FIG. 3, each tubular module 20 supports part of the porous support 6. Furthermore, each tubular module 20 includes through openings, like those illustrated in FIG. 2, allowing the fuel to pass from the inside of the tubular module 20 to the porous support 6.

The tubular modules 20 are advantageously similar. In particular, they can be of equal length. According to the example of FIG. 1, the combustion tube 2 includes eight tubular modules 20. It could include less or more tubular modules 20. Thus, according to the example of FIG. 10, which will be described in more detail below, the combustion tube 2 includes for example nine tubular modules 20.

The tubular modules 20 are fixed end to end to each other to form the combustion tube. To this end, as can be seen in FIG. 3, the burner 1 includes fixing means making it possible to fix the adjacent tubular modules 20 in a rigid and sealed manner. The fixing means can include, in particular, fixing flanges 24, intended to be pressed in pairs, these flanges 24 can be kept tight against one another by screw-nut type tightening means.

The fixing flanges 24 can be arranged at the ends of the tubular modules 20. Thus, each tubular module 20 includes a first fixing flange 24, at an upstream end 20*a* of the tubular module 20, and a second fixing flange 24, at a downstream end. The first flange 24 of fixing a tubular module 20 is intended to be fixed to the second flange 24 of fixing a previous tubular module 20.

The flanges 24, possibly in the form of a plate, have a collar projecting radially from the lateral wall of the tubular modules 20 and therefore from the combustion tube. The flanges 24 are for example orthogonal to the longitudinal axis A. The fixing flanges 24 have an advantageously flat fixing face 240, intended to receive the fixing face of another fixing flange 24.

In one optional form, the fixing flanges 24 do not extend all around the combustion tube. They can have a primary notch 242 allowing passage of the porous support 6 at the junction of two adjacent tubular modules 20. As illustrated in FIG. 4 (where the porous support 6 is not represented), the fixing flanges 24 may include one or more secondary notches 244 at the bottom of the primary notch 242, in order to allow an escape of gas in the direction of the porous support 6 at the junction of the tubular modules 20. This or these secondary notches 244 form calibrated leakage means, between the tubular module 20 and the porous support 6, on the one hand, and between the two adjacent tubular modules 20, on the other hand. The calibrated leakage means are located under the porous support 6, to ensure the continuity of the flame at the junction of two tubular modules 20.

Advantageously, the fixing flanges 24 do not only extend outside the combustion tube 2 by forming a collar, but also inside the combustion tube 2, forming a partition wall 246 preventing the passage of the fuel located in the combustion tube 2 from one tubular module 20 to the other (except via the calibrated leakage means), as illustrated in FIG. 3. This partitioning allows a more homogeneous distribution of the fuel along the burner 1. The partition wall 246 extends annularly around the distribution tube(s) 4 responsible for distributing the fuel in the tubular modules 20.

The fixing flanges 24 may have one or more axial through openings 248 allowing the passage of a distribution tube 4. In one optional form, each through opening 248 has a shape complementary to that of the distribution tube 4 that it receives. The through opening(s) 248 extend through the partition wall 246 to allow the distribution tube(s) to pass through the junction of two adjacent tubular modules 20. According to the example of FIG. 3, the fixing flanges 24 comprise a single central through opening 248, allowing the passage of the single distribution tube 4. According to the example of FIGS. 10 to 18, the fixing flanges 24 comprise one, two or three through openings 248 each allowing the passage of a distinct distribution tube 4.

The fixing flanges 24 thus close the ends of the tubular modules 20, except to achieve the calibrated leakage or to allow the passage of the distribution tube(s) 4 from one module 20 to another. The fixing flanges 24 also make it possible to support the distribution tube(s) 4 which extend inside the combustion tube 2. This or these distribution tubes 4 in fact rest on the inner edge delimiting the corresponding through opening 248.

The distribution tube(s) 4 are intended to distribute the fuel in a predetermined manner within the combustion tube 2. Each distribution tube 4 extends inside the combustion tube, along the longitudinal axis A, and includes (see for example FIG. 18) an orifice 40 allowing fuel inlet. This inlet orifice 40 can extend inside a supply module 8 of the burner 1.

Unlike the combustion tube 2, the distribution tube(s) 4 are advantageously not designed in a modular fashion and can extend in a single piece from their upstream end where the inlet orifice is located up to their downstream end. The distribution tube(s) 4 have a smaller diameter than the combustion tube 2 to allow the fuel to circulate about the distribution tube(s) 4, that is to say in the combustion tube 2, once the fuel has left the distribution tube 4.

As described above, each distribution tube 4 can be supported and held in place inside the combustion tube 2 by means of the fixing flanges 24.

Each distribution tube 4 includes a distribution portion 42, including one or more distribution orifices 420 (see FIGS. 14, 15) through a lateral wall of the distribution tube 4, to allow the passage of fuel from the inside of the distribution tube 4 into the combustion tube 2. The distribution orifices 420 can be in the form of slots, advantageously orthogonal to the longitudinal axis A of the burner 1. They can be arranged in staggered rows.

With reference to FIG. 6, the burner 1 includes a single distribution tube 4 and therefore a single combustion zone. This single distribution tube 4, more precisely its distribution portion 42, extends through all the tubular modules 20 of the combustion tube 2 in order to distribute the fuel in each of these tubular modules 20, all along the burner 1. As visible in FIG. 6, the distribution orifices 420 are in this example arranged diametrically opposed to the porous support 6 in order to homogeneously distribute within the combustion tube. Moreover, these distribution orifices 420 can be distributed at regular intervals along the axis A, and for example aligned.

With reference to FIG. 10, and to FIGS. 11 to 18, the burner 1 can alternatively include several distribution tubes 4 making it possible to create several combustion zones A, B, C which can be controlled independently of one another. Where appropriate, each distribution tube 4 is intended to distribute the fuel in a predetermined combustion zone of the combustion tube 2.

In particular, these distribution tubes 4 include a primary distribution 4, which is intended to distribute the fuel in the combustion zone A most upstream of the combustion tube 2, and one or more (e.g., two according to the example of FIGS. 10 to 13) secondary distribution tubes 4 intended to distribute the fuel in combustion zones B, C located downstream.

For example, as illustrated in FIGS. 10 to 13, the combustion tube 2 includes three combustion zones A, B, C, and consequently three distribution tubes 4 for distributing the fuel in each of the three combustion zones A, B, C. Each combustion zone can be formed by the same number of tubular modules 20, for example three (e.g., the combustion tube 2 here including nine tubular modules 20). FIG. 11 shows the first combustion zone, FIG. 12 the second combustion zone, FIG. 13 the last combustion zone.

The primary and secondary distribution tubes 4 each include a distribution portion 42 having distribution orifices 420 intended to allow the passage of the fuel from the inside of the primary or secondary distribution tube 4, into the corresponding zone of the combustion tube 2. In one optional form, these distribution orifices 420 are arranged facing the porous support 6. In one optional form, the distribution portion 42 extends from the first to the penultimate of the tubular modules 20 forming the concerned combustion zone.

Referring to FIGS. 14 and 15, it will be noted that the distribution portion 42 advantageously has an upstream portion 42*a* having, at equal length of the section, a larger perforation zone than a downstream portion 42*b*. In particular, the upstream portion 42*a* includes more distribution orifices 420 than a section of the same length of the downstream portion 42*b* and/or distribution orifices 420 distributed over a wider angle than for the downstream portion 42*b*. In one optional form, the distribution orifices 420 of the upstream portion 42*a* are arranged all around, i.e., at 360°, about the axis A. The downstream portion 42*b* has distribution orifices 420 distributed over an angular range, for example comprised between 100° and 140°, in one optional form being between 110° and 130°, for example 119°, about the axis A.

Referring to FIGS. 16 and 17, the distribution portion 42 of the primary and secondary distribution tubes 4 advantageously includes an end portion 44 which is axially closed by a deflector plug 440 making it possible to slow the arrival of fuel at the end of the combustion zone, as illustrated in FIG. 17. In addition, as visible in FIG. 16, the end part 44 includes a radial outlet opening 442 making it possible to release the rest of the fuel inside the last tubular module 20 from the corresponding combustion zone. Unlike the distribution orifices 420 of the distribution portion 42, this radial outlet opening 442 is advantageously arranged diametrically opposed to the porous support 6.

The end portion 44 extends into the last of the tubular modules 20 forming the combustion zone served by the corresponding distribution tube 4. In one optional form, this terminal part 44 is arranged at the level of the upstream end 20*a* of this tubular module 20, or in any case at a distance from the downstream end 20*b*, advantageously closer to the upstream end 20*a* than to the downstream end 20*b*. The end portion 44 extends over a length substantially shorter than that of the distribution portion 42. For example, the length of the distribution tube 4 in the last tubular module 20 of the served combustion zone is less than a fifth, and in one optional form is less than a tenth of the length of this tubular module 20.

The secondary distribution tubes 4 further include a blind portion 46 which is located upstream of their distribution portion 42. This blind portion 46, in the form of a tube without perforations on its lateral wall, is intended to extend through the combustion zone(s) located upstream of that served by the distribution portion 42 of the same distribution tube 4.

Referring to FIG. 11, the first combustion zone A is formed by the first three tubular modules 20.1, 20.2, 20.3 of the combustion tube 2, and the primary distribution tube 4A extends through these first three tubular modules 20.1, 20.2, 20.3. In particular, the distribution portion 42 of the primary combustion tube 2 extends through the first and the second tubular module 20.1, 20.2. At the start of the combustion zone A, i.e., at the level of the upstream end of the first tubular module 20.1, the distribution portion 42 has an upstream portion 42*a* having a larger perforation zone than a downstream portion, for example at 360°. In the remainder of the first tubular module 20.1, as well as in the second tubular module 20.2, the distribution portion 42 has perforations arranged opposite the porous support 6, with a perforation zone smaller than the upstream portion 42*a*, for example at 119°. Finally, in the third and last tubular module 20.3 forming this first combustion zone A, the primary distribution tube 4 includes an end part 44 having the deflector plug 440 and a radial outlet opening 442. This end part 44 extends near the upstream end 20*a* of the last of the tubular modules 20.3 forming the first combustion zone A, over approximately one tenth of the length of this last tubular module 20.3.

With reference to FIG. 12, the second combustion zone B is formed by the following three tubular modules 20.4, 20.5, 20.6 (fourth, fifth and sixth modules) of the combustion tube. The secondary distribution tube 4, which serves the third combustion zone C, has its blind part 46 extending through the modules 20.4, 20.5, 20.6, so that it does not distribute fuel in this second combustion zone B. The distribution portion 42 of the secondary distribution tube 4 serving the second combustion zone B extends through the fourth and the fifth tubular modules 20.4, 20.5. At the start of the second combustion zone B, i.e., at the level of the upstream end of the fourth tubular module 20.4, the distribution portion 42 has an upstream portion 42*a* having a larger perforation zone, for example at 360°, than the downstream portion 42*b*. In the remainder of the fourth tubular module 20.4, as well as in the fifth tubular module 20.5, the distribution portion 42 has distribution orifices 420 arranged facing the porous support 6, with a perforation zone smaller than the upstream portion 42*a*, for example at 119°. Finally, in the sixth and last tubular module 20.6 forming this second combustion zone B, the secondary distribution tube 4 serving this second combustion zone B includes an end portion 44 having a deflector plug 440 and a radial outlet opening 442. This end portion 44 extends near the upstream end of the last of the tubular modules 20.6, over approximately one tenth of the length of the latter tubular module 20.6.

With reference to FIG. 13, the third combustion zone C is formed by the following three tubular modules 20.7, 20.8, 20.9 (seventh, eighth and ninth modules) of the combustion tube. The distribution portion 42 of the secondary distribution tube 4 serving this third combustion zone C extends through the seventh and the eighth tubular modules 20.7, 20.8. At the start of the third combustion zone C, i.e., at the level of the upstream end of the seventh tubular module 20.7, the distribution portion 42 has an upstream portion 42*a* having a larger perforation zone, for example at 360°, than a downstream portion 42*b*. In the remainder of the seventh tubular module 20.7, as well as in the eighth tubular module 20.8, the distribution portion 42 has distribution orifices 420 arranged opposite the porous support 6, with a perforation zone smaller than the upstream portion 42*a*, for example at 119°. Finally, in the ninth and last tubular module 20.9 forming this third combustion zone C, the distribution tube 4 includes an end part 44 having a deflector plug 440 and a radial outlet opening 442. This end part 44 extends near the upstream end of the last of the tubular modules 20.9, over approximately one tenth of the length of this last tubular module 20.9.

As indicated previously, the burner 1 includes a supply module 8 connected upstream of the combustion tube 2 to supply each distribution tube 4 with fuel. The supply module 8, as well as the closure module 10 where appropriate, can be connected to the first, respectively to the last, of the tubular modules 20 forming the combustion tube 2 by means of the fixing means described above, like the fixing brackets 24. The supply module 8 allows the fuel supply of the distribution tube(s) 4.

The burner 1 advantageously includes means for adjusting the flow rate of fuel entering the distribution tube 4, or into each distribution tube 4. When there are several distribution tubes 4, the adjustment means allow the fuel flow rate to be adjusted for each distribution tube 4 independently of each other. As illustrated in FIG. 18, the adjusting means can comprise, for each distribution tube 4, an adjustment screw 80.

With reference to FIGS. 8 and 9, the supply module 8 includes sparking means, such as for example electrodes 82 visible in FIG. 8, making it possible to start the combustion, and an end portion connected to the first tubular module 20, this terminal portion 84 including one or more sparking orifices 840 passing through a lateral wall of the supply module 8 under the sparking means in order to allow fuel to pass to the sparking means. The porous support 6 extends between the sparking means and the sparking orifice(s) 840. At equal length of section, the perforation zone of this end portion 84 is advantageously larger than that of the downstream combustion tube 2. The sparking orifices 840 can be in the form of slots, advantageously orthogonal to the longitudinal axis A of the burner 1. These sparking orifices can be arranged in staggered rows.

The disclosure also concerns a furnace the burner 1 such as previously described. In particular, this furnace can be a food furnace intended for cooking foods.

The disclosure is in no way limited to the specific forms described above, these forms have been given only by way of example. Those of skill in the art will appreciate that modifications to the examples can be done, in particular from the point of view of the constitution of the various devices or by the substitution of technical equivalents, without thereby departing from the scope of protection of the disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

The invention claimed is:

1. A burner comprising:

a porous support;

a combustion tube along which is mounted the porous support, the combustion tube defining at least one opening configured to pass fuel towards the porous support, wherein the combustion tube is formed of a plurality of tubular modules assembled together;

at least one distribution tube extending inside the combustion tube and configured to distribute the fuel in a predetermined manner in the combustion tube; and a fixing means configured to fix, in a sealed manner, adjacent tubular modules of the plurality of tubular modules, wherein the fixing means comprise calibrated leakage means configured to allow fuel to pass to the porous support at a junction of the adjacent tubular modules.

2. The burner according to claim 1, wherein each opening of the at least one opening of the combustion tube is a slot orthogonal to a longitudinal axis of the burner.

3. The burner according to claim 1, wherein the fixing means comprise fixing flanges bearing against one another.

4. The burner according to claim 3, wherein the fixing flanges support said at least one distribution tube inside the combustion tube.

5. The burner according to claim 1, wherein the at least one distribution tube is a single distribution tube and the burner includes only the single distribution tube.

6. The burner according to claim 5, wherein the single distribution tube comprises one or more distribution orifices arranged opposite the porous support.

7. The burner according to claim 1, wherein the at least one distribution tube comprises a plurality of distribution tubes, of which a primary distribution tube is configured to distribute the fuel in a first combustion zone formed by one or more tubular modules of the plurality of tubular modules of the combustion tube, and at least one secondary distribution tube is configured to distribute the fuel in a predetermined manner in a second combustion zone downstream relative to the first combustion zone and formed by one or more other tubular modules of the plurality of tubular modules of the combustion tube.

8. The burner according to claim 7, wherein the primary distribution tube and said at least one secondary distribution tube each have a distribution portion including an upstream portion having a perforation zone larger than a downstream portion.

9. The burner according to claim 7, wherein the primary distribution tube and said at least one secondary distribution tube each have a distribution portion comprising distribution orifices arranged opposite the porous support.

10. The burner according to claim 7, wherein the primary distribution tube and said at least one secondary distribution tube have an end portion comprising an axial plug and a radial outlet opening.

11. The burner according to claim 10, wherein the end portion is arranged at a distance from a downstream end of the corresponding combustion zone.

12. The burner according to claim 7 further comprising adjustment means configured to independently adjust a flow of the fuel entering each distribution tube of the at least one distribution tube.

13. A furnace comprising the burner according to claim 1.

14. The burner according to claim 11, wherein the end portion is arranged at an upstream end of a last tubular module of the one or more tubular modules forming said corresponding combustion zone.

* * * * *